United States Patent [19]

Spalla

[11] 4,072,125

[45] Feb. 7, 1978

[54] UMPIRE'S COUNTER

[76] Inventor: Thomas W. Spalla, 607 Arbor Lane, Pittsburgh, Pa. 15236

[21] Appl. No.: 697,052

[22] Filed: June 17, 1976

[51] Int. Cl.[2] ..... A63B 71/06

[52] U.S. Cl. ..... 116/120; 116/133

[58] Field of Search ..... 116/120, 133, 134; 40/70 R, 113; 273/25; 235/1 B, 135

[56] References Cited

U.S. PATENT DOCUMENTS

| | | | |
|---|---|---|---|
| 2,980,055 | 4/1961 | Burns | 116/133 |
| 2,993,288 | 7/1961 | Rothman | 116/120 |
| 3,455,273 | 7/1969 | Willingham | 116/133 |
| 3,554,159 | 1/1971 | Klupt | 116/120 |
| 3,755,939 | 9/1973 | Denega | 40/70 R |

*Primary Examiner*—Charles A. Ruehl
*Assistant Examiner*—Denis E. Corr
*Attorney, Agent, or Firm*—William J. Ruano

[57] ABSTRACT

An umpire's counter which, in addition to the usual "strike", "ball" and "out" dial indicators, is provided with a novel "inning" dial indicator which is geared to the "out" indicator so as to indicate the "top half" of an inning and the "bottom half" of the inning after three outs.

2 Claims, 2 Drawing Figures

UMPIRE'S COUNTER

This invention relates to an umpire's counter.

In the usual umpire's counter, three separate dials are provided, each of which is independently turned to indicate the number of "strikes," "balls" and "outs" by numerals appearing on or near the periphery of each dial.

An outstanding disadvantage of such counter is that no provision is made for denoting the particular "inning," which often times involves dispute from failure of the umpire to recall the number of innings remaining.

An object of the present invention is to overcome the above-named disadvantage of presently used umpire counters by providing a novel umpire's counter wherein, in addition to the separate and independent "strike," "ball" and "out" dials, there is provided an "inning" dial.

A more specific object of the present invention is to correlate by gearing with the "out" dial, the number of the innings as well as to indicate the "top" and "bottom halves" of the respective innings.

Figure 1:
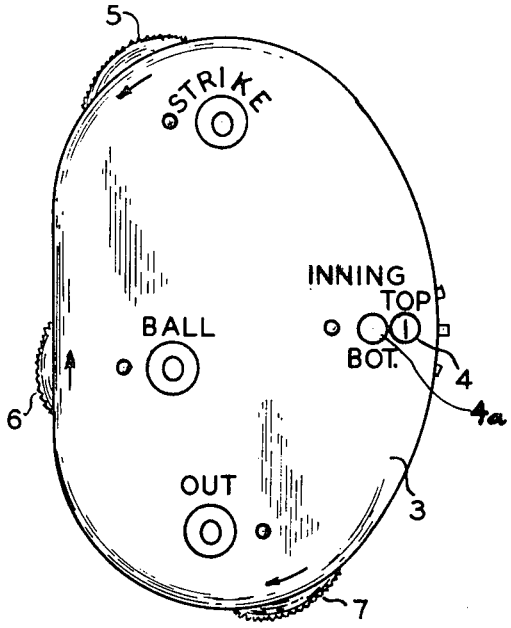
Figure 2:
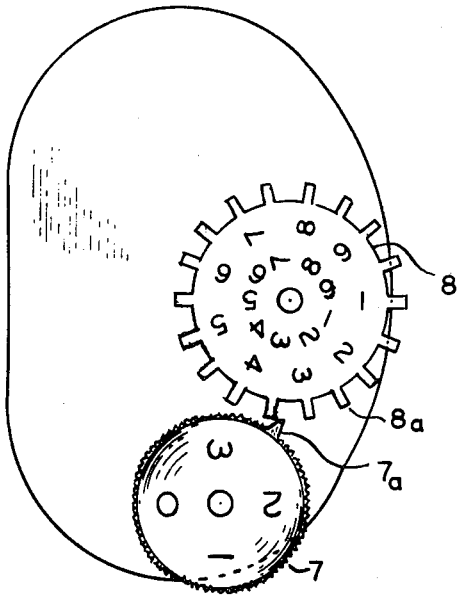

Other objects and advantages will become more apparent from a study of the following description taken with the accompanying drawings wherein:

FIG. 1 is a plan view of an umpire's counter embodying the usual "stike," "ball" and "out" dials, as well as a novel "inning" dial embodying the present invention; and FIG. 2 is a plan view with a cover removed, as well as "strike" and "ball" dials removed to better illustrate the operation of the "inning" dial which is added in accordance with the present invention;

Referring more particularly to FIG. 1 of the drawing, numeral 3 denotes a cover plate of metal or plastic material which, together with a companion cover plate on the opposite side, forms an enclosure for rotatably mounting therein a "strike" indicating dial 5, a "ball" indicating dial 6, and an "out" indicating dial 7, of usual construction, each having numerals along the periphery to denote how many have occurred, by turning the knurled portions of the respective dials by the thumb of the umpire.

Since there is often a dispute as to the particular inning of the baseball game, I have added, in accordance with the present invention, an inning indicating dial 8 provided with 18 cogs or gear teeth 8*a* which are geared to a gear tooth 7*a* so that upon each complete rotation of the "out" indicating dial 7, — that is, after three outs, the inning indicator is turned by one tooth to indicate the particular part of the inning.

As seen in FIG. 1, numeral 4 denotes an opening in cover plate 3 exposing numeral 1 denoting the "top" half of the first inning, denoted by the legend "TOP" on the cover plate 3.

As the "out" dial 7 is turned a complete revolution following three outs, numeral 1 on the inner circular path will appear in the inner opening 4*a* to indicate the "bottom" half of the same inning, as represented by the legend "bottom". Then as dial 7 is turned a complete revolution to indicate three more outs, the dial 8 is advanced by another digit so that opening 4 will now show numeral 2, denoting the top half of the second inning, — and after three more outs, the numeral 2 will appear at the inner opening 4*a* to denote the bottom half of the second inning, and so on.

After the bottom half of the ninth inning, the numbers will start all over again beginning with number 1 and ending with 9, as shown in FIG. 2.

Of course, in order to make a counter of less expense, the gearing with the "out" dial may be omitted and the "inning" dial 8 may be used independently, such as the other dials. The inning dial 8 may be advanced accompanied by a clicking noise, obtained with a spring leaf struck out from an inner plate cooperating with cavities in the "out" dial at each movement corresponding to the peripheral distance of one tooth 8*a*.

When gearing of the "inning" dial indicator is used, as shown in FIG. 2, if there is any malfunction requiring temporary disengagement, the "out" dial 7 or the "inning" dial 8 may be moved axially against the action of a return spring just for a sufficient time to correct the fault.

Thus it will be seen that I have provided an efficient and highly useful umpire's counter which embodies, in addition to the usual counter, an "inning" indicating dial geared to the "out" dial so that upon each three outs, the top or bottom half of a particular inning is designated so as to give a continuous indication, to the umpire, of the precise inning and part thereof (top or bottom half).

While I have illustrated and described a single specific embodiment of my invention, it will be understood that this is by way of illustration only and that various changes and modifications may be contemplated in my invention and within the scope of the following claims.

I claim:

1. In an umpire's counter comprising a top cover plate and a bottom cover plate in closely spaced parallel relationship and "strike," "ball" and "out" indicating dials rotatably mounted therebetween with indicia visible from the outside of the top plate; the improvement comprising an "inning" indicating dial rotatably mounted between said cover plates and visible through opening means in said top plate and geared to said "out" indicating dial such that for each three outs, said "inning" indicating dial will be turned and advanced to denote another half inning.

2. An umpire's counter as recited in claim 1 wherein said "inning" indicating dial has two concentric scales, one indicating the top half of the innings and the other indicating the bottom halves thereof, said top cover plate having two openings through which said two scales may be alternately observed.

* * * * *